United States Patent [19]

Harris et al.

[11] 4,084,530

[45] Apr. 18, 1978

[54] BALING OF WATERBORNE CRAFT

[75] Inventors: Gordon Colin Harris, Bridgend, Wales; Robert Paul Vere, Cirencester; Ronald Walker, Denton, both of England

[73] Assignee: United Kingdom of Great Britain and Northern Ireland, The Secretary of State for Defence in Her Brittannic Majesty's Government of the, London, England

[21] Appl. No.: 692,502

[22] Filed: Jun. 3, 1976

[51] Int. Cl.[2] ..... B63B 13/00

[52] U.S. Cl. ..... 114/183 R; 9/2 A; 9/11 A

[58] Field of Search ..... 9/3, 11 R, 11 A, 2 A; 114/183 R, 184, 183 A; 417/472, 478

[56] References Cited

U.S. PATENT DOCUMENTS

| | | | |
|---|---|---|---|
| 828,852 | 8/1906 | Ingersoll | 9/3 |
| 1,787,153 | 12/1930 | Huffman | 417/478 X |
| 2,384,721 | 9/1945 | Bingham | 9/11 |
| 3,475,772 | 11/1969 | Lokken | 114/183 R X |

FOREIGN PATENT DOCUMENTS

| | | | |
|---|---|---|---|
| 1,425,573 | 2/1976 | United Kingdom | 114/183 R |

*Primary Examiner*—Robert B. Reeves
*Assistant Examiner*—Edward M. Wacyra
*Attorney, Agent, or Firm*—Cameron, Kerkam, Sutton, Stowell & Stowell

[57] ABSTRACT

A craft, especially an inflatable dinghy, having a manually operable baler system comprising a flexible tube passing through the floor of the craft, a funnel mouth to the free end of the tube, and a non-return valve disposed to prevent water entering the craft by the tube, the tube being long enough to permit the funnel to be raised above the normal outside water level when the craft is floating loaded.

33 Claims, 3 Drawing Figures

BALING OF WATERBORNE CRAFT

The present invention relates to balers in small waterborne craft, particularly in inflatable survival dinghies of the type used by military personnel.

Current survival dinghies usually have a canopy attached to the sides thereof, the canopy having a closable entry opening through which the user climbs or the users climb into the dinghy. These dinghies, whether inflated before or after entering the water, usually incur some ingress of water by the time their users have climbed in. Such water can considerably sap both heat and spirits of the occupant and can prejudice his survival. Hitherto baler means has generally been provided with the dinghy, comprising a waterproof fabric pan and a sponge, but this required the canopy to be opened, exposing the occupant to the elements. In a rough sea it is possible for more fresh, cold water to be let in through that canopy opening than the baler can remove. Of course any small waterborne craft usually ships some water when afloat.

The present invention provides means for removing substantially all bilge water from the interior of a waterborne craft such as an inflatable dinghy without requiring the occupant to open the canopy if one is provided.

According to the present invention a waterborne craft has a baler assembly comprising a flexible waterproof tube within the craft and sealed to the floor thereof and at least one non-return valve disposed to prevent water flow into the craft via the tube, the tube having at its free end a funnel mouth. It will be appreciated that in the operation of a baler assembly according to the invention the funnel mouth is used to scoop up bilge water and either raised above the level of water outside the craft to obtain draining of the water through the tube or the tube is collapsed manually in a peristaltic manner to express the water. The assembly is advantageously arranged for both modes of operation.

According to a feature of the invention the valve or one of the valves may be disposed below the floor of the craft, thereby maximising the amount of water which can be expressed if the peristaltic mode of operation is employed and imparting a measure of safety in the event of failure of the tube or the tube/floor joint.

Preferably the assembly comprises two non-return valves, one below the floor as described and the other near the free end of the tube. Either of the valves, especially the lower, and preferably both, may comprise a flexible waterproof fabric tube having two diametrically opposite permanent creases urging the tube to flatten. Insofar as the craft has a longitudinal axis, that is an axis coincident with a prevailing direction of travel, it is advantageous for a below-floor valve, formed as described above, to be disposed with the diameter on which the creases lie transverse or normal to the said longitudinal axis, so that water flow past the craft assists in the closure of the valve.

The permanent creases may be obtained using adhesive or stitching or both.

Advantageously, therefore, the tube and the valves are made of a flexible waterproof fabric so as to be capable both of having substantially all water in the baler assembly expressed manually therefrom and also of being stowed so as to occupy a minimum of space. This is also likely to have a weight advantage over other possible embodiments of the invention. These features make the invention particularly suitable for use on airborne inflatable survival dinghies.

The fabric may be a plastics sheet but is preferably a synthetic rubber or plastics reinforced with a woven thread such as cotton or nylon.

The funnel mouth of the tube is preferably contained in a funnel portion thereto. This may resemble the traditional survival dinghy baler, which is somewhat hemispherical in shape and has a soft wire reinforced rim.

Preferably such a funnel portion is right conical in shape and is reinforced at the rim with a resilient metal or plastic ring, which tends to retain a circular shape to the mouth of the funnel. In a single seat craft the funnel mouth is preferably no larger than can be encompassed and held by the finger tips of a man, so that it can be used one-handed. The funnel mouth of a multi-seat dinghy baler assembly may be larger. The tube may also be conical, tapering down to the floor of the craft.

In order to minimise the risk of damage to the baler assembly by moving personnel the assembly may be rendered more robust by a reinforcement of two or more fabric tapes extending, perhaps in sleeves in the wall tube, between the funnel and floor of the craft, to which latter they may be anchored. Moreover there may be provided stowage means such as a pocket or one or more flaps.

In a single seat survival dinghy the assembly is preferably sited so that in use it is between the knees or lower thighs of the user, and may be stowed by detachable means, eg Velcro (TM) strips, fastening it to the foot end of the dinghy so that the funnel nestles between the floor and the wall there. Certain other survival aids such as sponge, hole sealers, and hand pump may be stowed in the funnel portion of the baler assembly, and the cordage attaching these to the dinghy may then be held down by the same detachable means and prevented thereby from tangling with other cordage.

In use of a baler assembly in accordance with the invention the funnel portion is dipped below the surface of the water in the dinghy and filled therewith. It is then lifted out of the water, whereby water, then above the level of that outside the dinghy, drains out through the tube and non-return valve(s), which latter prevents return flow. The provision of a resilient rim to the funnel portion enables ready sweeping up of shallow puddles of water. It will be appreciated that this baler assembly can be used with the canopy to the craft, if provided, closed and moreover that it can be used while the occupant is looking elsewhere, e.g. watching for search craft or watching the waves to prevent motion sickness. Operating the baler assembly with one hand may permit him to operate a signal device with the other. In a choppy sea it can be emptied using the hands in a peristaltic mode. The assembly may also be used as a latrine.

In a multi-seat dinghy, which may be liable to ship considerably more water than the single seat dinghy, a plurality of baler assemblies may be provided, some conveniently located for use by personnel seated against the sides of the dinghy.

A multi-seat and a single seat survival dinghy baler assembly will now be described by way of example with reference to the accompanying drawings in which.

Figure 1:
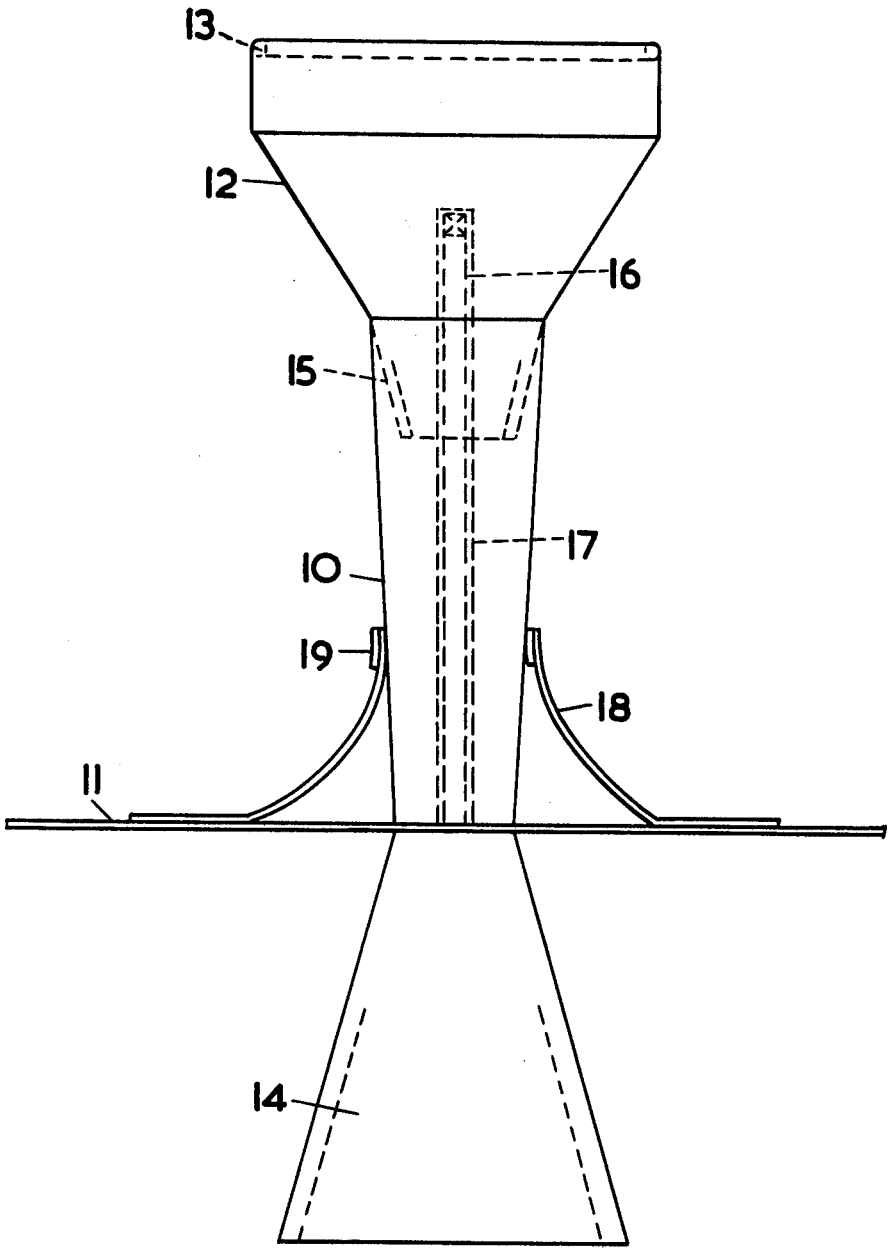
FIG. 1 shows a multi-seat inflatable survival dinghy baler assembly.
Figure 2:
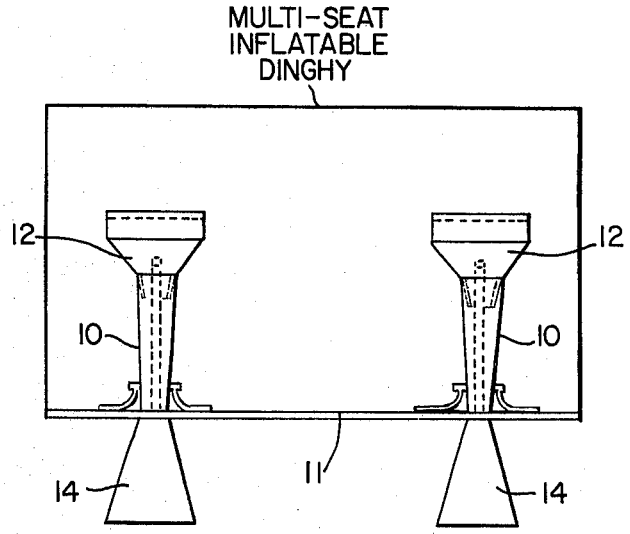
FIG. 2 is a diagrammatic view of a multi-seat inflatable dinghy incorporating a plurality of multi-seat baler assemblies.

Referring to FIG. 1, a multi-seat inflatable survival dinghy baler assembly comprises an -tube 10 about 17 in. long and tapering from 6 in. to 4 in. diameter. The narrow end is attached to the inside floor 11 of the dinghy and the tube projects into the dinghy. A conical funnel 12 is attached to the wide end of the tube, the mouth of the funnel being 14 in. diameter. The rim of the funnel is reinforced with a 3/16 in. cross-section diameter nylon ring 13. Beneath the dinghy floor the tube communicates with a flap valve 14 in the form of a tube 14 in. long tapering from 4 in. to 5 in. The free end of this tube, which like the inner tube 10 and the funnel 12 is made of reinforced butyl rubber, is stitched over 4 in. of tube length in two diametrically opposite locations to crease the tube and predispose it to flatten. A second non-return valve 15 of similar construction but 4 in. long, is attached within the assembly at the seam between the funnel and the inner tube.

Two reinforcing fabric tapes 16 pass from diametrically opposite positions on the funnel wall inside the inner tube and are anchored to the dinghy floor. The tapes pass through tunnels 17 stitched to the wall of the inner tube.

Two stowage flaps 18 are anchored to the dinghy floor on either side of the inner tube 10. The outer edge of each flap 18 carries a Velcro (TM) fastener 19 so that the flaps may attach one to the other over the rolled up baler assembly. The baler is used by dipping the mouth of the funnel 12 under the surface of the water in the dinghy to catch water in the funnel. The funnel is then raised, preferably to its fullest extent so that water therein drains at least through the upper flap valve 15. With repeated dipping and raising of the funnel water will drain out of the lower flap valve 14. The reinforcement 13 of the rim of the funnel 12 allows a shallow puddle of water on the floor of the dinghy to be readily shovelled into the funnel. Any remaining water picked up by means of a sponge can be squeezed into the funnel as well.

If in a choppy sea difficulty is experienced in getting the baler to function properly the tube 10 may be manually manipulated in a peristaltic manner.

If the assembly is fouled by personnel the reinforcing tapes 16 tend to ensure at least that it will not be pulled away from the floor 11.

To stow the assembly it is rolled up, an action that will squeeze much of any remaining water in the inner tube out of the lower flap valve, and the flaps 18 are fastened over it.

Figure 3:
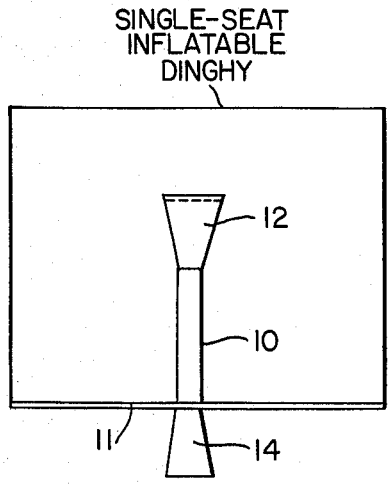
FIG. 3 is a diagrammatic view of a single-seat inflatable dinghy incorporating a single baler assembly.

Seat inflatable survival dinghy baler assembly as shown in FIG. 3 is somewhat similar in construction to that in the multi-seat dinghy described above, but made of rubberised cotton. The inner tube 10 is 14 in. long and 2 in. diameter and is not tapered. The conical funnel 12 is 6 in. long and has a rough diameter of 5 in. so that it can be encompassed and held by the finger tips of one hand. The funnel rim is reinforced with a nylon ring 13 as above. The lower flap valve 14 is 5 in. long and its nominal lower diameter is 3 in.

The assembly is located on the floor 11 of the dinghy where in use it will project between the knees or lower thighs of the user. Single seat survival dinghies usually have underwater drogues which cause them to face the occupant downstream of water current. The lower flap valve 14 is arranged to flatten in a plane transverse to the dinghy longitude. The water current then assists in closing the valve.

Stowage of the single seat dinghy baler is preferably accomplished by tucking the funnel into the junction of the floor with the foot end of the wall of the dinghy. Velcro (TM) fasteners on the funnel serve to retain it in the stowed position. Various other survival aids, including the traditional baler and sponge, a puncture repair outfit and hand pump can be stowed in the funnel. The cord attaching these to the dinghy may be retained to the assembly by a Velcro (TM) patch attached to the inner tube at the junction thereof with the funnel.

The assembly is used in a manner similar to the multi-seat baler described above.

In either case the baler can of course be used with the canopy, if provided, closed, and may serve as a latrine. Tests of the single seat survival dinghy baler assembly described have shown that, following entry into the dinghy from the water by an airman substantially all the water in the dinghy can be removed by this baler assembly within 6 minutes.

An important consideration with respect to airborne survival equipment is that of bulk and weight and it will readily be appreciated that the baler assemblies herein described are relatively bulk and weight free and afford hardly any impediment to the packing and stowing of an uninflated dinghy.

We claim:

1. A craft having at least one manually operable baler assembly comprising a flexible waterproof tube within the craft and sealed to the floor thereof and at least one non-return valve arranged to permit only flow of liquid out of the craft via the tube by gravity, the tube having a funnel mouth within the craft, said tube being long enough for the funnel mouth to be raised in use above the normal level of water exterior to the craft when loaded.

2. A craft as claimed in claim 1 and wherein said non-return valve is located beneath the floor of the craft.

3. A craft as claimed in claim 2 and having a definable longitudinal axis and wherein said non-return valve comprises a waterproof flexible fabric tube having two diametrically opposite permanent creases urging the tube to flatten, the valve being disposed with the said diameter normal to the said longitudinal axis.

4. A craft as claimed in claim 1 and having a second non-return valve located in the tube just below the funnel mouth.

5. A craft as claimed in claim 4 and wherein the second non-return valve comprises a waterproof flexible tube having two diametrically opposite permanent creases urging the tube to flatten.

6. A craft as claimed in claim 4 and wherein the second non-return valve is made of a woven thread reinforced plastics material.

7. A craft as claimed in claim 1 and wherein said non-return valve comprises a waterproof flexible fabric tube having two diametrically opposite permanent creases urging the tube to flatten.

8. A craft as claimed in claim 1 and wherein the funnel mouth has a resilient reinforcement at the rim.

9. A craft as claimed in claim 1 and wherein the at least one baler assembly has a reinforcement comprising a plurality of tapes extending between the tube close to the funnel mouth and the floor of the craft.

10. A craft as claimed in claim 1 and having at least one baler assembly stowage flap.

11. A craft as claimed in claim 1 and which is an inflatable dinghy.

12. A craft as claimed in claim 11 and which is a single seat survival dinghy.

13. A craft as claimed in claim 12 and wherein the baler is sited so that in use it is operable between the occupant's thighs.

14. A craft as claimed in claim 11 and which is a multi-seat survival dinghy.

15. A craft as claimed in claim 1 and which is an inflatable multi-seat survival dinghy having a plurality of the said baler assemblies.

16. A craft as claimed in claim 1 and wherein the at least one baler assembly tube and non-return valve are made of flexible waterproof fabric.

17. A craft as claimed in claim 16 and wherein the fabric is a woven thread reinforced plastics material.

18. An inflatable dinghy having at least one baler system comprising a tube and a non-return valve both made of waterproof fabric, one end of the tube being attached to the floor inside the dinghy and communicating the interior of the dinghy with the exterior beneath the floor and the other end of the tube being formed as a funnel and the tube being long enough for and arranged to permit the funnel portion to be lifted above the normal level of water outside the dinghy when it is floating loaded, and the non-return valve being disposed beneath the floor of the dinghy.

19. A dinghy as claimed in claim 18 and wherein the at least one baler system has a second non-return valve, made of waterproof fabric, and disposed in the tube just below the funnel portion of the tube.

20. A dinghy as claimed in claim 19 and wherein said second non-return valve comprises a waterproof fabric tube having two diametrically opposite permanent creases urging the tube to flatten.

21. A dinghy as claimed in claim 19 and wherein the waterproof fabric of the second non-return valve is a woven thread reinforced plastics material.

22. A dinghy as claimed in claim 18 and wherein said non-return valve comprises a waterproof fabric tube having two diametrically opposite permanent creases urging the tube to flatten.

23. A inflatable dinghy as claimed in claim 22 having a definable longitudinal axis and wherein the second non-return valve is disposed with said diameter lying normal to the said longitudinal axis.

24. An inflatable dinghy as claimed in claim 18 and wherein the funnel mouth has a resilient reinforcement at the rim thereof.

25. An inflatable dinghy as claimed in claim 18 and having at least one baler assembly stowage flap.

26. A dinghy as claimed in claim 18 and wherein the waterproof fabric is a woven thread reinforced plastics material.

27. A single seat inflatable dinghy having a baler system comprising a tube, and a non-return valve all made of waterproof fabric, one end of the tube being attached to the floor inside the dinghy at a point which will in use of the dinghy lie between the occupant's thighs and in such a manner that the tube communicates the interior of the dinghy with the exterior beneath the floor, the other end of the tube being formed as a funnel and the tube being long enough and arranged to permit the funnel portion to be lifted above the normal level of water which will be obtained outside the dinghy when it is floating loaded, and the non-return valve comprising a waterproof fabric tube having two diametrically opposite creases urging it to flatten, the valve being disposed below the floor of the dinghy with the said diameter normal to the longitudinal axis of the dinghy.

28. A dinghy as claimed in claim 27 and wherein the baler assembly has a second non-return valve comprising a waterproof fabric tube with diametrically opposite creases urging it to flatten and disposed within the tube just below the funnel portion.

29. A dinghy as claimed in claim 28 and wherein the fabric of the second return valve is a woven thread reinforced plastics material.

30. A dinghy as claimed in claim 27 and wherein the funnel portion has a resilient reinforcement at the rim thereof.

31. A dinghy as claimed in claim 27 and arranged for single-handed operation.

32. A dinghy as claimed in claim 31 and wherein the funnel mouth diameter is less than a normal adult hand span.

33. A dinghy as claimed in claim 27 and wherein the fabric is a woven thread reinforced plastics material.

* * * * *